US007989133B2

(12) United States Patent
Katano et al.

(10) Patent No.: US 7,989,133 B2
(45) Date of Patent: Aug. 2, 2011

(54) FIXING LIQUID, FIXING DEVICE USING THE FIXING LIQUID, AND IMAGE FORMING APPARATUS COMPRISING THE FIXING DEVICE

(75) Inventors: Yasuo Katano, Kanagawa (JP); Tsuneo Kurotori, Tokyo (JP); Tomoyasu Hirasawa, Tokyo (JP); Hiromichi Komai, Kanagawa (JP); Takuma Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 461 days.

(21) Appl. No.: 11/734,446

(22) Filed: Apr. 12, 2007

(65) Prior Publication Data

US 2007/0243483 A1 Oct. 18, 2007

(30) Foreign Application Priority Data

Apr. 17, 2006 (JP) ..... 2006-113193

(51) Int. Cl.
*G03G 13/20* (2006.01)

(52) U.S. Cl. ..... 430/124.21; 399/159

(58) Field of Classification Search ..... 430/124.21; 399/159

See application file for complete search history.

(56) References Cited

U.S. PATENT DOCUMENTS

| | | | | |
|---|---|---|---|---|
| 3,907,695 | A * | 9/1975 | Amidon et al. | 430/115 |
| 5,666,628 | A * | 9/1997 | Fukai | 399/340 |
| 2006/0115762 | A1 | 6/2006 | Katano et al. | |
| 2006/0263712 | A1 | 11/2006 | Katano et al. | |

FOREIGN PATENT DOCUMENTS

| | | | |
|---|---|---|---|
| JP | 59-119364 | | 7/1984 |
| JP | 07-044034 | * | 2/1995 |
| JP | 3290513 | | 3/2002 |
| JP | 2002-258544 | * | 9/2002 |
| JP | 2004-109749 | | 4/2004 |
| JP | 2004-109751 | * | 4/2004 |

OTHER PUBLICATIONS

English Translation of JP 07-044034 published Feb. 1995.*
English Translation of JP 2002-258544 published Sep. 2002.*
English Translation of JP 2004-109751 published Apr. 2004.*
U.S. Appl. No. 12/132,864, filed Jun. 4, 2008, Nakamura, et al.
U.S. Appl. No. 12/276,528, filed Nov. 24, 2008, Katano, et al.

* cited by examiner

*Primary Examiner* — Mark F Huff
*Assistant Examiner* — Peter L Vajda
(74) *Attorney, Agent, or Firm* — Oblon, Spivak, McClelland, Maier & Neustadt, L.L.P.

(57) ABSTRACT

The present invention provides a fixing liquid for fixing microparticles containing a resin to a medium, a fixing device using this fixing liquid, and an image forming apparatus comprising this fixing device. The fixing liquid of the present invention is a fixing liquid for fixing resin microparticles to a medium, and is a water-in-oil type fixing liquid comprising a continuous oil phase at least one portion of which comprises a softener for softening the resin microparticles by dissolving or swelling at least one portion of the resin microparticles, and an aqueous phase, as a separate phase, dispersed in the oil phase. As a result, the fixing liquid combines preservability during storage and drying property on a medium after application of the fixing liquid, is free of residual oily feel during application, and affords better fixing responsiveness than conventional fixing liquids.

11 Claims, 9 Drawing Sheets

FIG. 8

| | FIXING LIQUID 1 | FIXING LIQUID 2 | FIXING LIQUID 3 | FIXING LIQUID 3 | FIXING LIQUID 4 | FIXING LIQUID 5 |
|---|---|---|---|---|---|---|
| AQUEOUS PHASE | 95wt% | 90wt% | 70wt% | 60wt% | 50wt% | 40wt% |
| OIL PHASE | 5wt% | 10wt% | 30wt% | 40wt% | 50wt% | 60wt% |
| VISCOSITY (Pa·s) | 20 | 10 | 6 | 1 | 0.8 | 0.3 |

FIG. 9

| | FIXING LIQUID 7 | FIXING LIQUID 8 | FIXING LIQUID 9 | FIXING LIQUID 10 |
|---|---|---|---|---|
| OIL BASED SOLVENT | 0wt% | 40wt% | 56wt% | 64wt% |
| SOFTNER | 80wt% | 40wt% | 24wt% | 16wt% |
| WEIGHT RATIO OF OIL BASED SOLVENT TO SOFTNER | 0/100 | 5/5 | 7/3 | 8/2 |

FIXING LIQUID, FIXING DEVICE USING THE FIXING LIQUID, AND IMAGE FORMING APPARATUS COMPRISING THE FIXING DEVICE

BACKGROUND OF THE INVENTION

1. Field of the Invention

The present invention relates to a fixing liquid for fixing microparticles containing a resin to a medium, a fixing device using this fixing liquid, and an image forming apparatus comprising this fixing device.

2. Description of the Related Art

Image forming apparatuses such as a printer, a facsimile machine, and a copying machine are apparatuses for forming an image, which may include characters and/or symbols, on a recording medium such as paper, cloth, and an OHP sheet, based on image information. Particularly, electrophotographic image forming apparatuses have been widely used in offices since a high-definition image can be formed on a normal paper with high speed. In such an electrophotographic image forming apparatus, a heat fixing method has been widely used in which toner is fixed on a recording medium by heating or fusing the toner on the recording medium and by pressing the fused toner. This heat-fixing method has been preferably used since a high fixing speed, a high fixed image quality, and the like can be provided.

However, approximately half or more of electric power consumed in such an electrophotographic image forming apparatus is consumed for heating toner in the heat fixing method. On the other hand, a fixing device with low electric power consumption (intended for energy conservation) is desired from the viewpoint of recent measures against environmental problems. That is, a fixing method is desired which does not require to extremely lower the temperature at which toner is heated, compared to a conventional case, or to heat toner, with a view of fixing the toner. Particularly, a non-heat fixing method of fixing toner on a recording medium, in which toner is not heated at all, is ideal as regards low electric power consumption.

As such no-heat fixing method, for example, Japanese Patent No. 3290513 (Prior Art 1) discloses a method for wet-fixing toner which includes spraying or dropping an oil-drop-in-water-type fixing agent, in which an organic compound capable of dissolving or swelling toner and insoluble or hardly soluble in water is dispersed and mixed in water, onto a surface of an object to be subjected to fixing and on which unfixed toner is disposed at a predetermined position, followed by drying the object subjected to fixing.

Since the wet-fixing method disclosed in the Prior Art 1 uses an oil-drop-in-water-type fixing agent in which an organic compound insoluble or hardly soluble in water is dispersed and mixed in water, however, when a large quantity of the fixing agent is provided to unfixed toner, a recording medium (an object to be subjected to fixing) such as transfer paper or the like absorbs water of the fixing agent, whereupon wrinkles and/or curls form on the recording medium. Accordingly, this impairs remarkably the stability and high speed of conveyance of the recording medium required by the image forming apparatus. Then, where a large quantity of water contained in the fixing agent is evaporated using a dryer so as to remove the water content from the fixing agent provided on a the recording medium, electric power is needed which corresponds to the electric power consumed in an image forming apparatus using the heat-fixing method.

Also, usually, the surface of toner particles is water-repellency treated with hydrophobic silica or the like, in order to prevent the toner particles from absorbing atmospheric moisture and from aggregating with one another, and to preserve the fluidity of the toner. Therefore, when an aqueous fixing liquid containing water as a dispersion medium, as the aforementioned fixing agent, is sprayed or dropped onto unfixed toner on a recording medium, the water-repellency treated toner particles are repelled by the aqueous fixing liquid. As a result, a blank portion is formed on a toner image and a defect is produced on the image. The aqueous fixing liquid is also prone to suffer the drawback of a changing component ratio in the fixing liquid as a result of water, as a diluted solvent, evaporating inside the image forming apparatus.

Herein, there is also disclosed, as a fixing liquid which does not repel water-repellency treated unfixed toner, an oil based fixing liquid in which a material capable of dissolving or swelling toner is dissolved in an oil based solvent. For example, Japanese Unexamined Patent Application Laid-open No. 2004-109749 (Prior Art 2) discloses a fixing liquid in which an ester from an aliphatic dibasic acid or the like, as a material component capable of dissolving or swelling a resin component that makes up a toner, is diluted with (or dissolved in) nonvolatile dimethyl silicone as a diluent (or solvent).

Also, Japanese Unexamined Patent Application Laid-open No. S59-119364 (Prior Art 3) discloses a fixing solution for fixing an unfixed toner image, the fixing solution dissolving the toner and being in a phase solution state resulting from mixing 8 to 120 parts by volume of a silicone oil into 100 parts by volume of a solvent having compatibility with the silicone oil, as a fixing solution that can be used in a fixing method that allows fixing an unfixed image, formed by an electrostatic method, on an image receiving sheet, easily and without disturbing the image. Since such an oil based fixing liquid contains an oil based solvent having a high affinity with water-repellency treated unfixed toner, the toner can be dissolved or swelled and fixed on a recording medium without repelling the water-repellency treated unfixed toner.

Herein, the use of a VOC (volatile organic compound) as an oil based solvent used for an oil based fixing liquid has an adverse affect on the human body, causes the generation of unpleasant odor and, therefore, is not preferable. Consequently, a nonvolatile oil based solvent is practically used as an oil based solvent employed in an oil based fixing liquid.

However, an oil based fixing liquid in which a material capable of dissolving or swelling toner is dissolved in a nonvolatile oil based solvent has a high permeability into a recording medium. Therefore, when an oil based fixing liquid as described above is sprayed or dropped onto unfixed toner on a recording medium, the oil based fixing liquid has a high speed of diffusion and/or penetration into and through the recording medium, and only a portion of the material capable of dissolving or swelling toner contained in the oil based fixing liquid dissolves or swells the unfixed toner on the recording medium. Thus, the residual portion of the material capable of dissolving or swelling toner is not utilized for dissolving or swelling the toner and diffuses into the recording medium, or passes through the recording medium, together with the oil based solvent.

Since only a portion of the material capable of dissolving or swelling toner contained in the oil based fixing liquid dissolves or swells the unfixed toner on the recording medium, it becomes necessary to increase, in the oil based fixing liquid, the concentration of the contained material capable of dissolving or swelling toner. For example, the concentration of a solvent dissolved into a silicone oil as an oil based solvent in the fixing solution disclosed in the Prior Art 3 must be at least 20 wt %. This results in low toner dissolving or swelling efficiency in an oil based fixing liquid where the material that dissolves or swells the toner is dissolved in a nonvolatile oil based solvent.

SUMMARY OF THE INVENTION

In order to solve the above problems, it is an object of the present invention to provide a fixing liquid, a fixing device using this fixing liquid, and an image forming apparatus comprising this fixing device, which allow fixing on a recording medium microparticles such as toner containing a resin, effectively and with small application amounts, the microparticles such as toner containing a resin becoming rapidly fixed to the recording medium after application on the recording medium without disturbing a microparticle layer of toner or the like containing a resin, with no residual oily feel occurring in the recording medium, the fixing liquid having moreover excellent preservability, in that the component ratio thereof does not change during storage.

In an aspect of the present invention, there is provided a fixing liquid for fixing resin microparticles to a medium. The fixing liquid is a water-in-oil type fixing liquid comprising a continuous oil phase at least one portion of which comprises a softener for softening the resin microparticles by dissolving or swelling at least one portion of the resin microparticles, and an aqueous phase, as a separate phase, dispersed in the oil phase.

In another aspect of the present invention, a fixing device has an application unit for applying a fixing liquid to unfixed resin microparticles adhered to a medium. The fixing liquid is a water-in-oil type fixing liquid comprising a continuous oil phase at least one portion of which comprises a softener for softening the resin microparticles by dissolving or swelling at least one portion of the resin microparticles, and an aqueous phase, as a separate phase, dispersed in the oil phase.

In another aspect of the present invention, an image forming apparatus comprises an image forming device for carrying out an electrostatic recording process with toner comprising a resin and for forming an unfixed toner image on a recording medium; and a fixing device for fixing the unfixed toner image on the recording medium using a fixing device. The fixing device has an application device applying a fixing liquid to resin microparticles of the unfixed toner image on the recording medium. The fixing liquid is a water-in-oil type fixing liquid comprising a continuous oil phase at least one portion of which comprises a softener for softening the resin microparticles by dissolving or swelling at least one portion of the resin microparticles, and an aqueous phase, as a separate phase, dispersed in the oil phase.

BRIEF DESCRIPTION OF THE DRAWINGS

The above and other objects, features and advantages of the present invention will become more apparent from the following detailed description taken with the accompanying drawings in which:

FIG. 8 is a table listing the viscosity of various fixing liquids prepared by modifying the ratio of aqueous phase to oil phase; and FIG. 9 is a table listing the weight ratio of oil based solvent to softener in various fixing liquids prepared by modifying the ratio of oil based solvent to softener in the oil phase.

DESCRIPTION OF THE PREFERRED EMBODIMENTS

Prior to the explanation of the present invention, the above-described conventional technology will be explained more in detail with reference to accompanying drawings.

Fixing of water-repellency treated toner provided with an aqueous fixing liquid when fixed on a recording medium will be explained first based on the drawings.

Figure 1A:
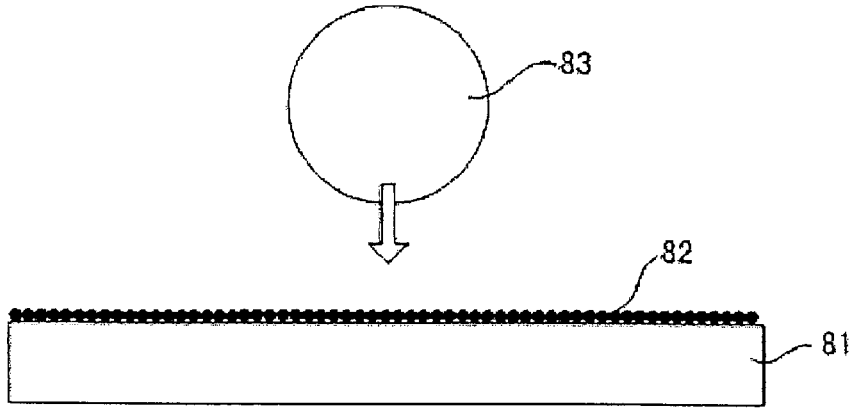
FIGS. 1A to 1C are diagrams illustrating how fixing takes place when an aqueous fixing liquid is applied onto a water-repellency treated toner on a recording medium.
Figure 1B:
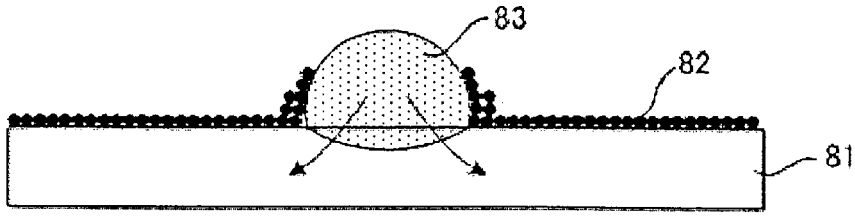
Figure 1C:
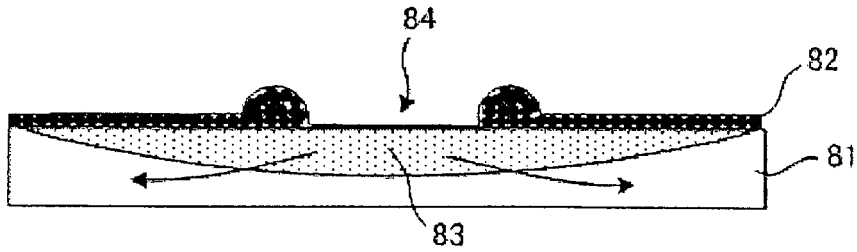

FIGS. 1A to 1C are diagrams illustrating how fixing takes place when an aqueous fixing liquid is applied onto a water-repellency treated toner on a recording medium. As shown in FIG. 1A, a liquid drop of an aqueous fixing liquid 83 is dropped, using a fixing liquid supply means not shown in the figure, onto a layer of water-repellency treated unfixed toner 82 transferred on a recording paper 81 as a recording medium. At this time, as shown in FIG. 1B, when the liquid drop of an aqueous fixing liquid 83 contacts the water-repellency treated unfixed toner layer 82, particles of the water-repellency treated unfixed toner layer 82 are repelled by the liquid drop of the aqueous fixing liquid 83. Consequently, as shown in FIG. 1C, the particles of the water-repellency treated unfixed toner layer 82, which have been repelled by the liquid drop of the aqueous fixing liquid 83, migrate to a peripheral portion of the liquid drop of the aqueous fixing liquid 83, as a result of the diffusion of the aqueous fixing liquid 83 in the recording paper 81. Then, an undesired blank portion 84 of the water-repellency treated toner forms on the water-repellency treated unfixed toner layer 82 transferred on the recording paper 81, and a defect appears on the image formed by the toner. Thus, when an aqueous fixing liquid is used, there is a problem in that the layer of unfixed toner transferred on the recording paper is easily disturbed.

Fixing of water-repellency treated toner provided with an oil based fixing liquid when fixed on a recording medium will be explained next based on the drawings.

Figure 2A:
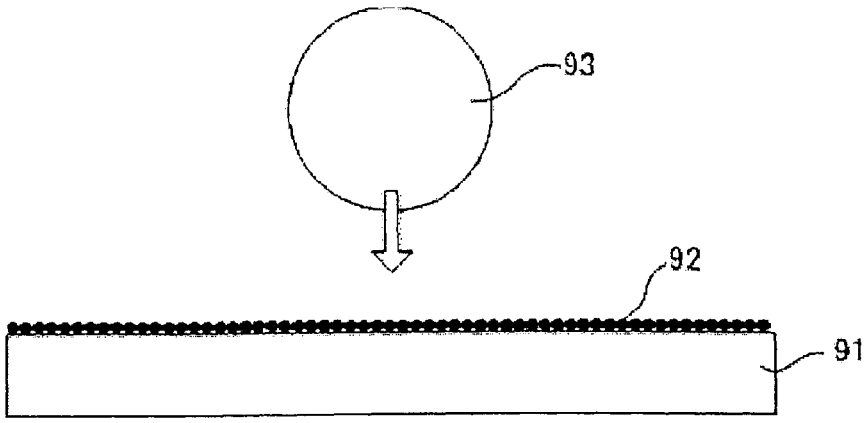
FIGS. 2A to 2C are diagrams illustrating how fixing takes place when an aqueous fixing liquid is applied onto a water-repellency treated toner on a recording medium.
Figure 2B:
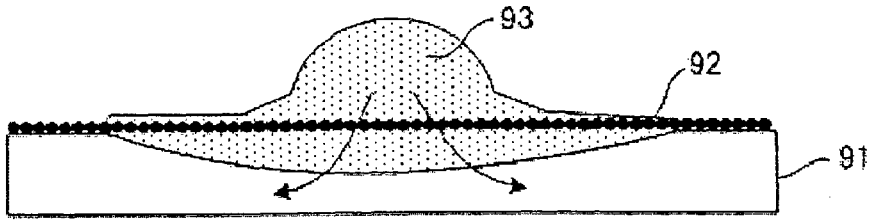
Figure 2C:
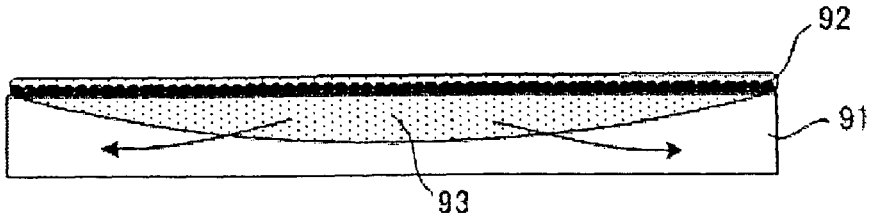

FIGS. 2A to 2C are diagrams illustrating how fixing takes place when an aqueous fixing liquid is applied onto a water-repellency treated toner on a recording medium. As shown in FIG. 2A, a liquid drop of an oil based fixing liquid 93 in which a material capable of dissolving or swelling toner is dissolved in a nonvolatile oil based solvent is dropped, using a fixing liquid supply means not shown in the figure, onto a water-repellency treated unfixed toner layer 92 transferred on a recording paper 91, as a recording medium. At this time, as shown in FIG. 2B, the oil based fixing liquid 93 contacting the recording paper 91 has a high permeability into the recording paper 91 and rapidly permeates into the recording paper 91. As a result, as shown in FIG. 2C, a portion of the material capable of dissolving or swelling toner contained in the oil based fixing liquid 93 can dissolve or swell the unfixed toner 92 on the recording paper 91 but the residual portion of the material capable of dissolving or swelling toner permeates and diffuses in the recording paper 91, together with the nonvolatile oil based solvent, without dissolving or swelling the unfixed toner 92 on the recording paper 91.

Thus, when using an oil based fixing liquid in which a material capable of dissolving or swelling toner is dissolved in a nonvolatile oil based solvent, there is a problem in that the utilization efficiency of the material capable of dissolving or swelling toner is low. Although the component ratio on the fixed portion does not change through evaporation, thanks to the use of a nonvolatile oil based solvent, the fixing liquid diffused into the paper remains in the paper for a long period of time after storage, so that, when a large amount of fixing liquid is applied to the unfixed toner, there arise several inconveniences such as a residual oily feel (a slight tacky feel upon touching the recording paper with the fingers) on the paper after fixing, as well as impaired writability with a water-based pen.

It becomes then necessary, in the fixing liquids described in the Prior Art 2 and Prior Art 3, to increase the proportion of the material capable of dissolving or swelling toner in the fixing liquid, and to apply extremely small amounts on the unfixed image. This is problematic in that, although an amount not more than 50 mg per A4 paper sheet is known not to elicit a residual oily feel on the recording paper, it is extremely difficult herein to apply homogenously such a small amount of nonvolatile fixing liquid on recording paper, and fixing defects become likelier.

The present invention, which solves the above-described problems of conventional technology, is described in detail next with reference to accompanying drawings.

Figure 3:
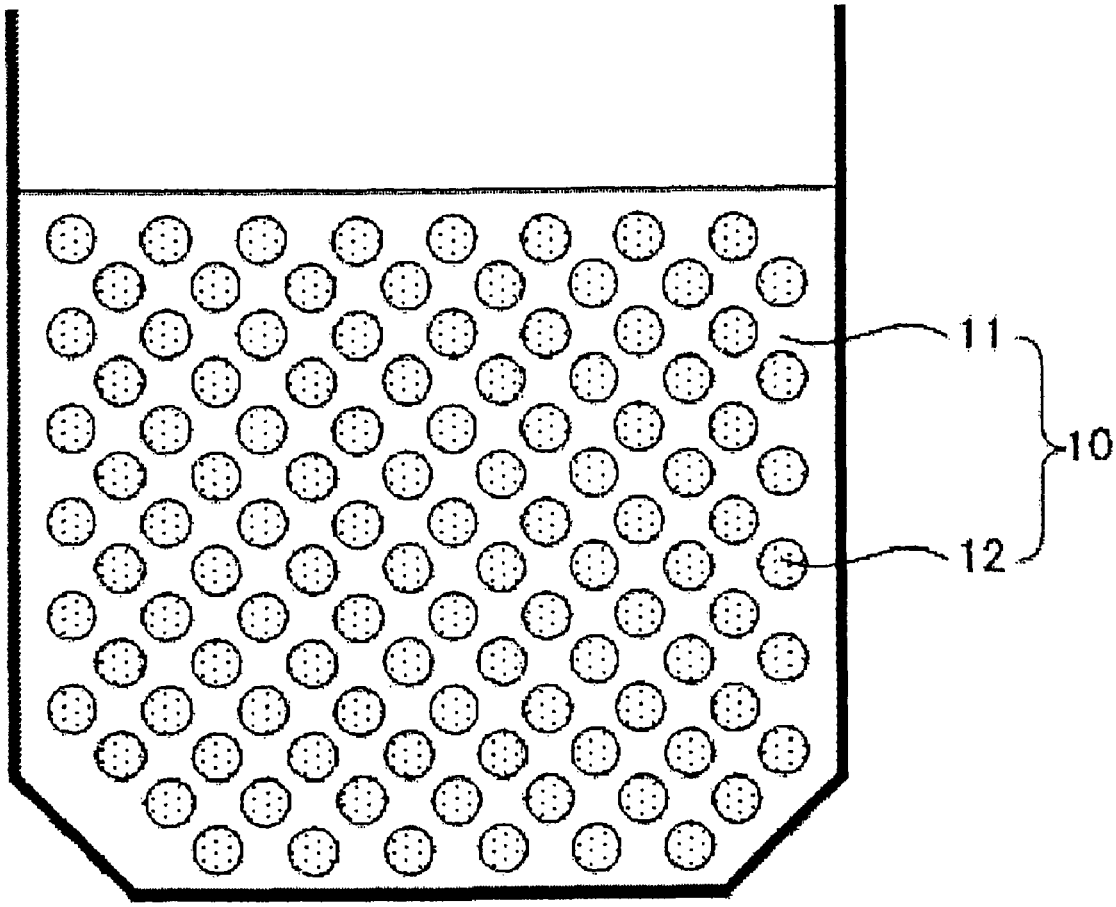
FIG. 3 is a schematic diagram illustrating a fixing liquid according to one embodiment of the present invention.

FIG. 3 illustrates a fixing liquid according to an embodiment of the present invention. In the figure, a fixing liquid 10 of the present embodiment is a fixing liquid for fixing microparticles containing a resin such as toner onto a medium such as a recording medium to which are attached microparticles containing a resin such as toner, the fixing liquid 10 being also a water-in-oil type (hereafter, W/O emulsion) fixing liquid in which a component (hereafter, softener) capable of dissolving or swelling at least one portion of the resin contained in the toner or the like is dispersed in an oil based solvent and forms a continuous oil phase 11, with an aqueous phase 12 as a separate phase being dispersed in the oil phase. The microparticles to be fixed, containing a resin, are not limited herein to toner, and may be any resin-containing microparticles. The microparticles may be, for instance, resin microparticles containing an electroconductive member. The medium is not limited to recording paper, and may also be, for instance, a resin, ceramics or the like. Also, the conformation of the medium is not limited to a sheet-like shape, and may be a three-dimensional body having flat faces and curved faces.

Among the above microparticles containing a resin, a toner used in electrophotographic process has the highest fixing effectiveness when combined with the fixing liquid of the present invention. The toner contains coloring agents, charge control agents, and resins such as a binder resin, a release agent and the like. The resin contained in the toner is not particularly limited but, in a preferable binder resin, a polystyrene resin, a styrene-acryl copolymer resin, a polyester resin or the like can be used, and in a releasing agent, for example, a wax component such as polyethylene can be used. Apart from the binder resin, the toner may comprise also well-known coloring agents, charge control agents, fluidity imparting agents, external additives and the like. Also, it is preferable that the toner be water-repellency treated by fixing, on the surface of the toner particles, hydrophobic fine particles such as hydrophobic silica having a methyl group and hydrophobic titanium oxide.

Among media, the recording medium is not particularly limited and, for example, paper, cloth, a plastic film such as an OHP sheet having a liquid penetrating layer or the like can be used. The component (softener) capable of dissolving or swelling at least one portion of the resin contained in the toner or the like is not particularly limited provided that it can dissolve or swell at least one portion of the resin contained in the toner or the like so as to fix the toner or the like on a recording medium. The oil based solvent containing the softener and forming the oil phase is used with the purpose of diluting the softener in the oil phase. In the present invention, "oil based" means that solubility in water at room temperature (20° C.) is 0.1 wt % or less. Preferably, the oil based solvent and the softener have sufficient affinity with the particles of water-repellency treated toner.

Herein, "affinity" means the degree of extensional wetting of liquid on the surface of a solid when the liquid contacts the solid. That is, it is preferable that the oil based solvent and the softener exhibit sufficient wettability vis-à-vis water-repellency treated toner. The surface of toner that has been water-repellency treated with hydrophobic fine particles such as hydrophobic silica particles and hydrophobic titanium oxide particles is covered with methyl groups of the hydrophobic silica particle and the hydrophobic titanium oxide particles, and has a surface energy of approximately 20 mN/m. Since the whole surface of the water-repellency treated toner is not completely covered with hydrophobic fine particles, the surface energy of the water-repellency treated toner is estimated to range approximately from 20 mN/m to 30 mN/m. Therefore, in order to have affinity (sufficient wettability) with the water-repellent toner, it is preferable that the surface tension of the oil based solvent and the softener be 20 mN/m to 30 mN/m.

As such oil based solvent can be used, for example, a fluorine-containing oil, a paraffinic oil, an olefinic oil, a silicone-based oil or the like. Among these, a solvent comprising an olefin compound is particularly superior in that it is nonvolatile even at a low viscosity, and hence allows adjusting viscosity by being added as a thickener. Among silicone-based solvents, dimethyl silicone has an extremely small surface tension, and has the best compatibility with toner.

The oil based solvent and the softener in the present invention are preferably nonvolatile and, more preferably, nonvolatile and non-polar. In the present invention, "nonvolatile" means having a boiling point of at least 260° C. under atmospheric pressure. If the boiling point is 260° C. or more, there occurs no loss of fixability or evaporation that may give rise to contamination in the image forming apparatus having the fixing device, even when the fixing liquid is stored in a simple and inexpensive container. If the boiling point is less than 260° C., it becomes necessary to ensure the air-tightness of the storage container and/or the air-tightness of the supply channels that supply liquid to the fixing device, which increases device costs.

In the W/O emulsion-type fixing liquid of the present invention, thus, the softener is contained in the oil phase. Herein, the softener may be dissolved in the oil based solvent that forms the oil phase, or may be dispersed in the oil based solvent. A dissolved condition of the softener affords a superior storage content stability of the softener in the oil based solvent, while a dispersed condition of the softener is superior for enhancing fixing responsiveness, since upon application of the fixing liquid onto the microparticle layer such as toner, the dispersed softener can be selectively trapped in the microparticle layer such as toner, thereby accelerating softening of the resin such as toner.

The softener may be contained simultaneously in the oil phase and in the aqueous phase. A softener contained in both the aqueous and the oil phases increases the opportunities for the microparticles such as toner to come into contact with the softener, thereby affording more efficient softening through dissolution or swelling of the resin containing the toner, and further increasing fixing responsiveness.

The aqueous phase comprises water and about 1 to 10 wt % of an electrolyte. Preferred electrolytes include herein magnesium sulfate and the like. To the aqueous phase may also be added a polyhydric alcohol with a view, for instance, of increasing viscosity, preventing freezing, and preventing evaporation.

It is preferable that the dispersing agent for stably dispersing the aqueous phase in the oil phase containing the softener be a surfactant having a HLB (hydrophile-lipophile balance) value of 5 or less. Herein, the HLB value may be, for example, a value calculated in accordance with HLB value=20×(molecular weight of a hydrophilic group of a surfactant)/(molecular weight of the surfactant), which is known as the Griffin formula.

Specific preferred dispersing agents include herein, for instance, sorbitan fatty acid esters such as sorbitan monolaurate, sorbitan monostearate, sorbitan sesquiolate and the like, and/or sucrose esters such as sucrose laurate, sucrose stearate and the like.

As a method for dispersing the aqueous phase in the oil phase, a fixing liquid according to the first embodiment of the present invention can be obtained by stirring the liquid constituting the oil phase using a rotating blade or the like while the liquid constituting the aqueous phase is gradually added thereto until achieving a desired aqueous phase/oil phase ratio, followed by mechanical stirring or vibrating of the obtained mixture. Herein can be used, for example, mechanical stirring means such as a homomixer, a homogenizer or the like using a rotating blade, and vibrating means such as an ultrasonic homogenizer. In either case, dispersion is carried out by applying a strong shear stress to the aqueous phase in the oil phase.

The W/O emulsion-type fixing liquid may also be stabilized through addition to the oil phase of a stabilizer such as cetanol, cetearyl alcohol, stearyl alcohol or the like, or through addition of ultrafine particles such as hydrophobic silica, hydrophobic titanium or the like.

The ratio of aqueous phase relative to oil phase in the W/O emulsion-type fixing liquid ranges preferably, in weight ratio, from aqueous phase/oil phase=5/5 to 9/1, and more preferably from aqueous phase/oil phase=6/4 to 7/3. Below 5/5, the shelf stability of the emulsion containing the softener in the oil phase becomes impaired, thereby promoting separation of the aqueous phase and the oil phase, whereas above 9/1, the W/O emulsion-type fixing liquid becomes highly viscous, reaching 20 Pa·s or more, thereby impairing permeability into the recording medium. In particular, a range of 6/4 to 7/3 allows ensuring dispersion stability during shelf storage, and yields viscosities in the range of 0.1 Pa·s to 10 Pa·s, that do not impair permeability into the recording medium.

It has been found that an application amount of nonvolatile oil based liquid not more than 50 mg per A4 paper sheet does not elicit in the user a residual oily feel of the recording paper. However, the lowest value for homogenous application, feasible in practice, using various application means, is of at least 100 mg per A4 paper sheet. When the medium is recording paper having irregularities, as in high-quality paper, application amounts smaller than 100 mg per A4 paper sheet result in regions where the recesses of the recording paper cannot be coated. This gives rise, in conventional fixing liquids containing a softener in an oil based solvent, to a residual oily feel after application of the fixing liquid on the recording paper, even when the content of softener is 100%. That is caused by the oily feel of the softener, which is itself nonvolatile.

By contrast, the fixing liquid of the present invention is a W/O emulsion-type having a large aqueous phase proportion, so that, for instance applying the oil phase to a recording medium in a residual oil feel-free amount of 50 mg per A4 sheet allows ensuring an application amount that can be homogeneously applied in practice, without giving rise to a residual oily feel, for an application amount of fixing liquid of 125 mg/A4, with a W/O ratio of 6/4, and an application amount of fixing liquid of 250 mg/A4, with a W/O ratio of 8/2.

The present embodiment affords thus a fixing liquid having excellent preservability, which does not disturb the toner layer, which does not elicit a residual oily feel on the recording medium, and which can fix toner more efficiently to the recording medium. The fixing liquid according to the present embodiment, also, is a W/O emulsion-type; when the fixing liquid is applied to the toner layer, thus, the oil phase, having a good affinity towards the toner, is the first to come into contact with the toner, so that no toner-disturbing forces are generated. This allows reducing the defects in the image formed by the toner supplied to the recording medium and caused by the application of the fixing liquid.

In the fixing liquid according to the present embodiment, the liquid surface in contact with air is covered by the oil phase, which is the continuous phase. When the oil phase is nonvolatile, this allows preventing evaporation of the aqueous phase, affording thereby excellent preservability.

Also, as explained above, application without residual oily feel becomes possible, within a range of feasible homogenous application amounts, for an aqueous phase/oil phase ratio in the fixing liquid ranging from 6/4 to 8/2.

After application, the oil phase and the aqueous phase separate immediately on the recording medium, with the oil phase, having affinity for the toner, permeating selectively and rapidly, while the excess aqueous phase evaporates on the surface. As a result, fixing responsiveness is enhanced vis-à-vis the application of a fixing liquid in which a softener is simply dissolved in an oil based solvent.

FIGS. 4A to 4D illustrate the process elapsing after application of the fixing liquid according to the present invention on the medium until fixing. In the figure, reference numerals identical to those of FIG. 3 denote identical constituent elements.

Figure 4A:
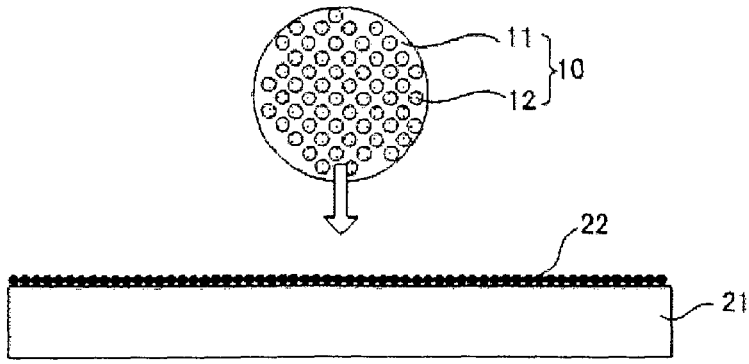
FIGS. 4A to 4D illustrate the process elapsing after application of the fixing liquid according to the present invention on the medium until fixing.
Figure 4B:
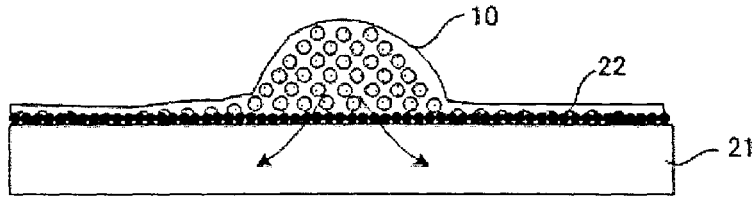
Figure 4C:
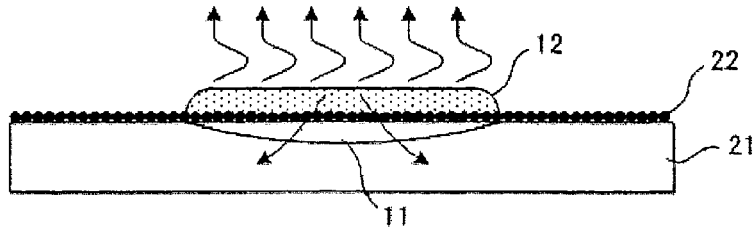

The fixing liquid 10 illustrated in FIG. 4A is a W/O emulsion-type fixing liquid in which an aqueous phase is dispersed in an oil phase containing a softener. As described above, the proportion of aqueous phase 12 is about the same, or higher, than that of the oil phase 11. As illustrated in FIG. 4B, when the fixing liquid 10 comes into contact with an unfixed microparticle layer 22 such as toner on a medium 21 such as recording paper, the fixing liquid 10 permeates selectively between the microparticles, without disturbing the microparticle array, thanks to affinity between the oil phase 11 in the W/O emulsion and the unfixed microparticle layer 22 such as toner. The aqueous phase 12 dispersed in the W/O emulsion, on the other hand, is repelled on account of the hydrophobicity of the microparticles such as toner, and can hardly permeate through the microparticle layer, so that, as illustrated in FIG. 4C, the oil phase 11 permeates into the unfixed microparticle layer 22 such as toner and the medium 21, while the aqueous phase 12 becomes trapped on the surface of the unfixed microparticle layer 22 such as toner, and disappears through water evaporation. The oil phase 11 permeates into the medium 21, and remains there.

Figure 4D:
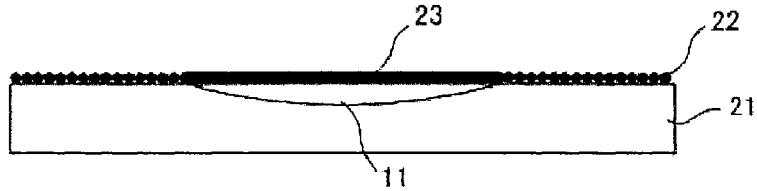

Then, as illustrated in FIG. 4D, the unfixed microparticle layer 22 such as toner softens through the action of the softener of the oil phase 11, the unfixed microparticles bond among them, and become fixed to the medium 21 as fixed microparticles 23. The nonvolatile oil phase 11 remains in the medium such as recording paper, as was the case in the conventional process example illustrated in FIG. 2C. Herein, however, the concentration of the oil phase in the fixing liquid, which was 100% in the conventional example, is diluted on account of the concentration of the aqueous phase in the W/O emulsion of the present invention, so that the oil phase concentration in the fixing liquid can be adjusted to 10% to 50%, as described above. As a result, this allows reducing substantially the amount of oil phase remaining in the medium, while enabling fixing with high responsiveness.

The particle size of the microparticles in the aqueous phase dispersed in the W/O emulsion-type fixing liquid ranges preferably from 0.1 μm to 6 μm. A particle size below 0.1 μm promotes penetration of the aqueous phase into the unfixed microparticle layer such as toner, delays water evaporation, can swell the pulp fibers that make up the recording paper, and may give rise to wrinkles and/or curls. On the other hand, a particle size above 6 μm may result in the microparticles of the aqueous phase disturbing by themselves the array of unfixed microparticles such as toner. The average particle size, which varies in accordance with the weighting employed for calculating the average value, is expressed usually as a surface average particle size and a volume average particle size having differing values.

In the present invention, the microparticles are all spherical, and hence particle size denotes particle diameter. In the present invention, also, the volume average particle diameter denotes the value determined by a laser diffraction scattering method, in which a particle size distribution is obtained based on the diffraction/scattering angle when a microparticle dispersion is irradiated with light of a wavelength of the order of the particle size, or the value determined by a Doppler scattering method, in which the speed of particles as a result of Brownian motion is determined based on Doppler scattered light and is converted to particle diameter.

The volume average diameter of microparticles in the aqueous phase dispersed in the W/O emulsion-type fixing liquid can be measured, for instance, by the laser diffraction scattering method (using an apparatus by Microtrac Inc. (MicroTrac HRA) at a wavelength of 780 nm and a temperature of 25° C.), or by the Doppler scattering method (using an apparatus by Microtrac Inc. (MicroTrac UPA) at a wavelength of 780 nm and a temperature of 25° C.).

When the softener makes up at least one portion of the oil phase, the ratio of the oil based solvent and the softener in the oil phase is set in accordance with the dispersion stability of the W/O emulsion and/or the rate of dissolution or swelling of the resin in the unfixed microparticles such as toner. A high ratio of oil based solvent tends to decrease the rate of dissolution or swelling of the resin in the unfixed microparticles such as toner, and hence the weight ratio of the oil based solvent and the softener in the oil phase is preferably 7/3 or less. The highest fixing responsiveness is afforded by an instance in which there is only softener, with no oil based solvent. Accordingly, the oil phase may be dispersant and softener alone. When the weight ratio of the oil based solvent to the softener in the oil phase is 8/2 or more, the oil based solvent becomes a factor that hampers dissolution or swelling of the resin in the unfixed microparticles such as toner, and fixing takes several hours, which is disadvantageous in practice.

In the fixing liquid of the present invention, preferably, the component (softener) capable of dissolving or swelling at least one portion of the resin contained in the toner includes an aliphatic ester. Aliphatic esters are excellent in the dissolution ability or swelling ability thereof for dissolving or swelling at least one portion of the resin contained in the toner or the like.

Also, the acute oral toxicity LD50 of the softener is preferably greater than 3 g/kg, and more preferably 5 g/kg, from the viewpoint of safety for humans. The safety of aliphatic esters for humans is high, and they are frequently used as a raw material for cosmetics.

Further, since fixing of toner onto a recording medium is conducted in an instrument which is frequently used in a closed environment, and the softener remains in the toner even after fixing of the toner on the recording medium, it is preferable that fixing of the toner onto the recording medium involves no generation of volatile organic compounds (VOC) or unpleasant odors. In other words, it is preferable that the softener contains no volatile organic compound (VOC) and no substance susceptible of causing an unpleasant odor. Herein, aliphatic esters have a high boiling point and low volatility, and no irritating odor, compared to commonly used organic solvents (toluene, xylene, methyl ethyl ketone, ethyl acetate or the like). Also, aliphatic esters have the advantage of causing no pollution of water quality.

An odor intensity index (10×log(dilution of a substance at which the odor of the material cannot be sensed)) based on a three-point odor bag method, which is a sensory measurement method, can be used herein as an index of odor intensity and thus as a practical odor yardstick that allows measuring odor in an office environment or the like with high precision.

It is preferable that the odor intensity index of the aliphatic ester contained in the softener be 10 or less. In this case, unpleasant odor is not sensed in an ordinary office environment. Also, it is preferable that not only the softener but also materials such as the oil based solvent contained in the W/O emulsion-type fixing liquid should have no unpleasant odor or irritating odor.

In the fixing liquid of the present invention, preferably, the aliphatic ester comprises a saturated aliphatic ester.

When the aliphatic ester comprises a saturated aliphatic ester, the preservation stability (resistance to oxidation, hydrolysis or the like) of the softener can be improved. Also, the safety of the saturated aliphatic ester for humans is high, and many of the saturated aliphatic esters can dissolve or swell the resin contained in the toner within 1 second. Further, the saturated aliphatic ester can reduce the tacky feel of the toner provided on the recording medium. This is arguably because the saturated aliphatic ester forms an oil film on the surface of the dissolved or swelled toner.

In the fixing liquid of the present invention, the saturated aliphatic ester comprises preferably a compound represented by general formula $$R_1COOR_2,$$

where $R_1$ is a $C_{11}$ to $C_{14}$ alkyl group and $R_2$ is a linear or branched $C_1$ to $C_6$ alkyl group.

When the saturated aliphatic ester comprises a compound represented by general formula $R_1$ $COOR_2$, where $R_1$ is a $C_{11}$ to $C_{14}$ alkyl group and $R_2$ is a linear or branched $C_1$ to $C_6$ alkyl group, the dissolution ability or swelling ability towards the resin contained in the toner can be improved. Also, the odor intensity index of the aforementioned compound is 10 or less and the aforementioned compound has no unpleasant odor or irritating odor.

As the aliphatic monocarboxylate ester being the above-described compound there can be used, for instance, ethyl laurate, hexyl laurate, ethyl tridecylate, isopropyl tridecylate, ethyl myristate, isopropyl myristate or the like. Many of these aliphatic monocarboxylate esters which are the aforementioned compound dissolve in the oil based solvent but do not dissolve in water. For many of the aliphatic monocarboxylate esters which are the aforementioned compound, therefore, the fixing liquid can be obtained for instance by manufacturing a W/O emulsion with water as the main constituent of the aqueous phase, and with the aliphatic monocarboxylate ester, which is the aforementioned compound, dissolved or dispersed in the oil based solvent, as the oil phase.

In the fixing liquid according to the present invention, preferably, the aliphatic ester comprises an aliphatic dicarboxylate ester.

When the aliphatic ester comprises an aliphatic dicarboxylate ester, the resin contained in the toner can be dissolved or swelled over a shorter time period. For high-speed character printing of approximately 600 ppm, for instance, it is desirable that the time lapsing from the fixing liquid being provided to unfixed toner on a recording medium until the toner becomes fixed on the recording medium should not exceed 1 second. When the aliphatic ester comprises an aliphatic dicarboxylate ester, the time lapse required for providing the fixing liquid to unfixed toner on a recording medium and fixing the toner on the recording medium can be made not to exceed 0.1 seconds. Further, since the resin contained in the toner can be dissolved or swelled by addition of a smaller quantity of the softener, the content of the softener in the fixing liquid can be reduced.

In the fixing liquid of the present invention, preferably, the aliphatic dicarboxylate ester comprises a compound represented by general formula $$R_3(COOR_4)_2,$$

where $R_3$ is a $C_3$ to $C_8$ alkylene group and $R_4$ is a $C_2$ to $C_5$ linear or branched alkyl group.

When the aliphatic dicarboxylate ester comprises a compound represented by general formula $R_3(COOR_4)_2$, where $R_3$ is a $C_3$ to $C_8$ alkylene group and $R_4$ is a $C_2$ to $C_5$ linear or branched alkyl group, the dissolution ability or swelling ability towards the resin contained in the toner can be improved. Also, the odor intensity index of the aforementioned compound is 10 or less and the aforementioned compound has no unpleasant odor or irritating odor.

As the aliphatic dicarboxylate ester being the aforementioned compound there can be used, for example, ethylhexyl succinate, dibutyl adipate, diisobutyl adipate, diisopropyl adipate, diisodecyl adipate, diethyl sebacate, dibutyl sebacate or the like. Many of these aliphatic dicarboxylate esters which are the aforementioned compound dissolve in the oil based solvent but do not dissolve in water. Therefore, the fixing liquid can be obtained for instance by manufacturing a W/O emulsion with water as the main constituent of the aqueous phase, and with the aliphatic dicarboxylate ester, which is the aforementioned compound, dissolved or dispersed in the oil based solvent, as the oil phase.

In the fixing liquid of the present invention, preferably, the aliphatic ester comprises a dialkoxyalkyl aliphatic dicarboxylate.

When the aliphatic ester comprises a dialkoxyalkyl aliphatic dicarboxylate, the fixability of the toner on a recording medium can be improved.

In the fixing liquid of the present invention, preferably, the dialkoxyalkyl aliphatic dicarboxylate includes a compound represented by general formula $$R_5(COOR_6—O—R_7)_2,$$

where $R_5$ is a $C_2$ to $C_8$ alkylene group, $R_6$ is a $C_2$ to $C_4$ alkylene group, and $R_7$ is a $C_1$ to $C_4$ alkyl group.

When the dialkoxyalkyl aliphatic dicarboxylate includes a compound represented by general formula $R_5(COOR_6—O—R_7)_2$, where $R_5$ is a $C_2$ to $C_8$ alkylene group, $R_6$ is a $C_2$ to $C_4$ alkylene group, and $R_7$ is a $C_1$ to $C_4$ alkyl group, the dissolution ability or swelling ability toward the resin contained in the toner can be improved. Also, the odor intensity index of the aforementioned compound is 10 or less and the aforementioned compound has no unpleasant odor or no irritating odor.

As the dialkoxyalkyl aliphatic dicarboxylate being the aforementioned compound there can be used, for example, diethoxyethyl succinate, dibutoxyethyl succinate, diethoxyethyl adipate, dibutoxyethyl adipate, diethoxyethyl sebacate or the like. The fixing liquid can be obtained by manufacturing a W/O emulsion with water as the main constituent of the aqueous phase, and with these dialkoxyalkyl aliphatic dicarboxylates, dissolved or dispersed in the oil based solvent, as the oil phase.

In the fixing liquid of the present invention, preferably, the oil based solvent forming the oil phase in the above-described W/O emulsion-type fixing liquid comprises an olefin compound. When the oil based solvent comprises an olefin compound, the fixing liquid has a particularly high affinity towards water-repellency treated toner and can significantly wet the water-repellency treated toner. That is, olefin compounds have low surface tensions, of 25 mN/m or less, and have thus high affinity towards water-repellency treated toner.

As a result, applying the fixing liquid of the present invention to water-repellency treated toner on the recording medium allows reducing disturbance of the image formed by the water-repellency treated toner. Among olefin compounds, for instance, poly-α olefins have extremely low volatility, and it has been observed that when drops of a W/O emulsion-type fixing liquid having such a poly-α olefin as the oil based solvent of the oil phase are applied to a layer of water-repellency treated toner, the toner layer exhibits virtually no disturbance. This is not limited to a hydrophobically treated toner, and the same effect is obtained for hydrophobically treated resin microparticles, or resin microparticles of an intrinsically hydrophobic resin.

In the fixing liquid of the present invention, preferably, the oil based solvent that forms the oil phase in the above-described W/O emulsion-type fixing liquid comprises dimethyl silicone.

When the oil based solvent comprises dimethyl silicone, the fixing liquid has a particularly high affinity towards water-repellency treated toner and can significantly wet the water-repellency treated toner. That is, dimethyl silicone, which is a silicone-based solvent, has a low surface tension, of approximately 20 mN/m, and has a high affinity with water-repellency treated toner. As a result, applying the fixing liquid of the present embodiment to water-repellency treated toner on the recording medium allows reducing disturbance of the image formed by the water-repellency treated toner.

Also, dimethyl silicone has no odor and is highly safe for humans. Therefore, a fixing liquid containing dimethyl silicone as the oil based solvent can be a fixing liquid having no odor and being safe for humans. For example, it has been confirmed that dimethyl silicone having a viscosity of 20 mPa·s or greater has a low volatility, and that when a liquid drop of a fixing liquid containing dimethyl silicone as the oil based solvent is applied to a layer of water-repellency treated toner, the toner layer exhibits virtually no disturbance.

Next, a toner fixing method of the present invention, in which the above fixing liquid of the present invention is used, is a method for carrying out fixing using a fixing device that comprises a container for holding a W/O-type fixing liquid, and means for transporting the fixing liquid from the container to an application means where the fixing liquid is applied to toner adhered to a recording medium. The fixing method provided by the invention, therefore, allows fixing toner more efficiently onto a recording medium, as described above.

Next, a toner fixing device of the present invention comprises, for example, a fixing liquid container for storing the above-described fixing liquid, fixing liquid supply means, for instance liquid drop flight means such as spray gun or an ink jet nozzle, and/or contact application means such as roller coating or the like, for supplying the fixing liquid to unfixed toner provided on a recording medium.

Also, the toner fixing device of the present invention may comprise a pair of smoothing rollers (hard rollers) for, after the fixing liquid of the present invention is provided to the toner, pressing toner dissolved or swelled by the component (softener) capable of dissolving or swelling at least one portion of the resin contained in the toner. Pressing of the dissolved or swelled toner by the pair of smoothing rollers (hard rollers), allows smoothing the surface of the layer of dissolved or swelled toner, thereby imparting gloss to the toner. Also, the fixability of the toner on the recording medium can be improved by pushing the dissolved or swelled toner into the recording medium.

Figure 5:
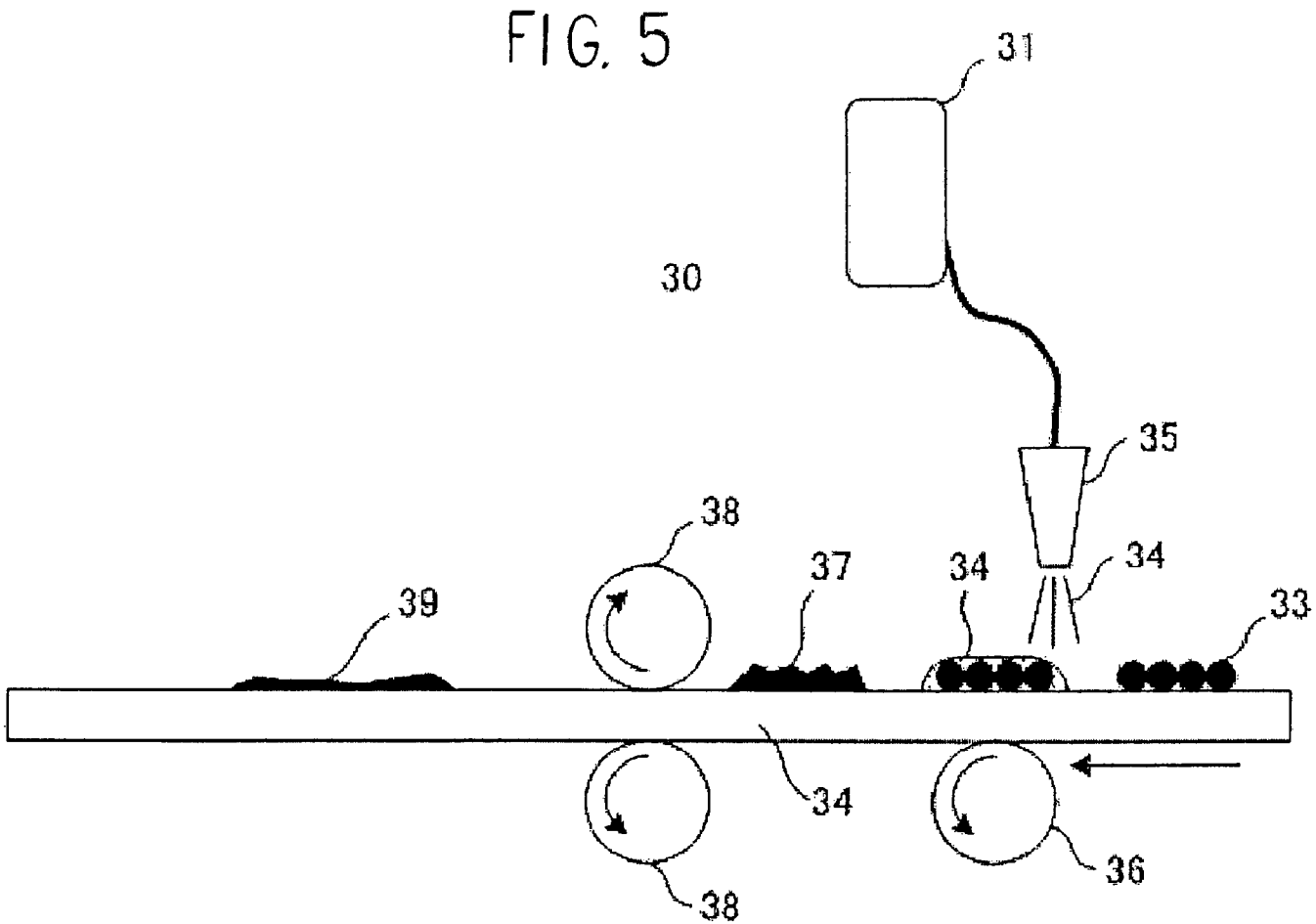
FIG. 5 is a diagram illustrating an example of the schematic constitution of a fixing device according to another embodiment of the present invention.

FIG. 5 is a diagram illustrating an example of the constitution of a fixing device according to another embodiment of the present invention. The fixing device 30 of the present embodiment illustrated in FIG. 5 comprises a fixing liquid container 31 for storing fixing liquid, fixing liquid supply means 35 such as a spray gun or the like for providing the fixing liquid 34 to unfixed toner 33 transferred on a recording medium 32, a conveyance roller 36 for conveying the recording medium 32 on which the unfixed toner 33 is provided, and a pair of smoothing rollers 38 for pressing toner 37 dissolved or swelled by the fixing liquid 34. In the fixing device 30 of the present embodiment shown in FIG. 5, the recording medium 32 on which the unfixed toner 33 is provided is conveyed by the conveyance roller 36, and the fixing liquid 34 stored in the fixing liquid container 31 is provided to the unfixed toner 33 on the recording medium 32 by the fixing liquid supply means 35. As the fixing liquid 34 is provided to the unfixed toner 33 on the recording medium 32, the toner is dissolved or swelled by the component (softener) contained in the fixing liquid 34 and capable of dissolving or swelling at least one portion of the resin contained in the toner. The toner 37 dissolved or swelled by the fixing liquid 34 is further conveyed, together with the recording medium 32, by the conveyance roller 36. Then, the toner 37 dissolved or swelled by the fixing liquid 34 is pressed by the pair of the smoothing rollers 38 and becomes fixed as fixed toner 39 on the recording medium 32.

Figure 6:
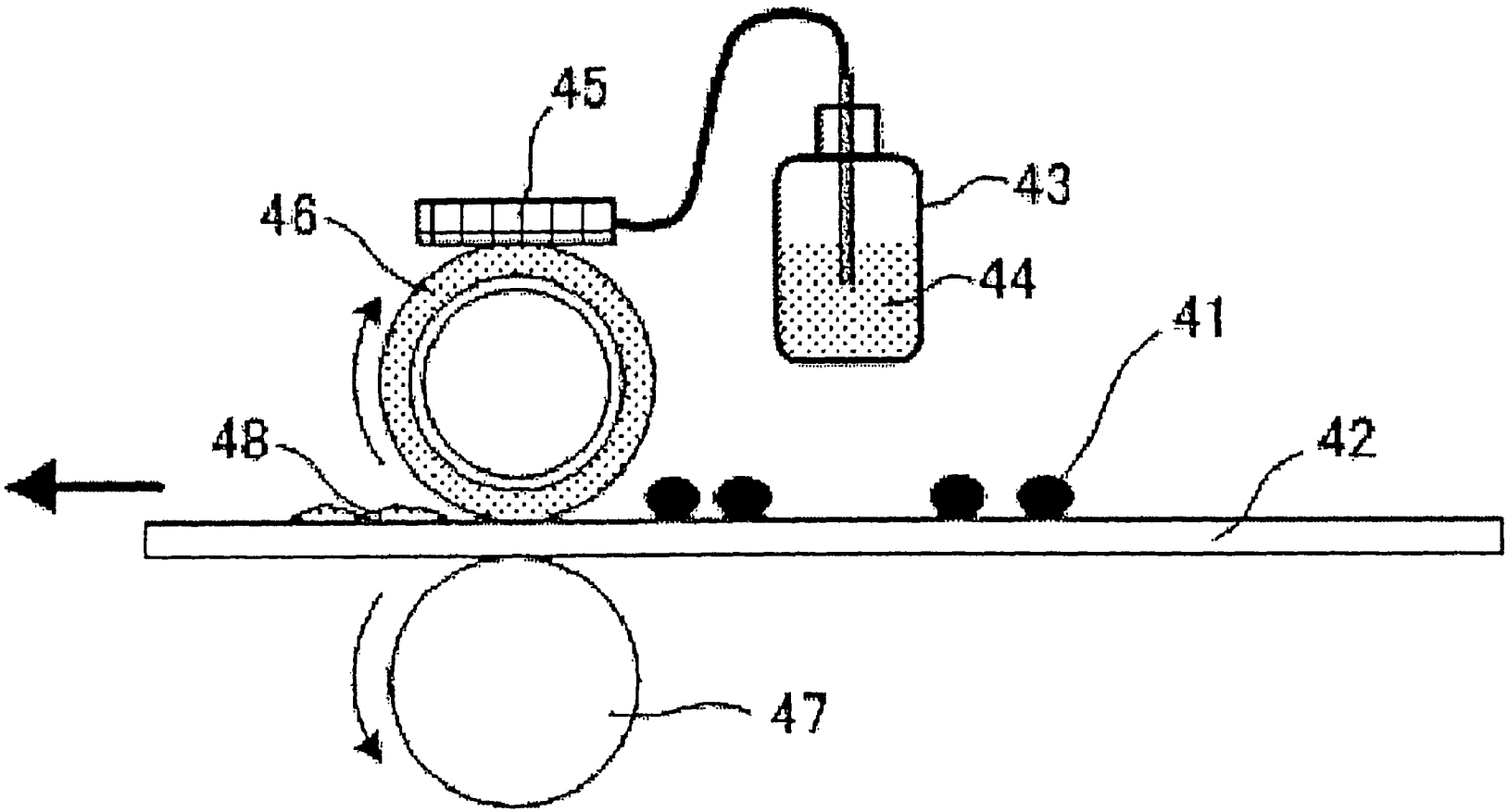
FIG. 6 is a diagram illustrating an example of the schematic constitution of a fixing device according to another embodiment of the present invention.

FIG. 6 is a diagram illustrating another example of the constitution of a fixing device according to another embodiment of the present invention. In the fixing device 40 illustrated in FIG. 6, a recording medium 42, upon which unfixed toner 41 is provided, is transported by a conveyance roller (not shown), and fixing liquid 44 stored in a fixing liquid filled tank 43 is supplied to a fixing liquid application pad 45 by fixing liquid supply means (not shown) such as a pump or the like, so that a small amount of fixing liquid drawn from the fixing liquid application pad 45 is formed on an application roller 46 that is in contact with the fixing liquid application pad 45. As the fixing liquid is supplied to the toner on the recording medium 42, the toner is dissolved or swelled by the component (softener) contained in the fixing liquid and capable of dissolving or swelling at least one portion of the resin contained in the toner. The unfixed toner 41 softens and is pressed by a smoothing roller 47 provided opposite the application roller 46 so as to flank the recording medium 42, and becomes fixed as fixed toner 48 on the recording medium 42.

In the image forming apparatus according to the present invention, next, an image of toner comprising a resin is formed on a recording medium using the above-described image forming method. In this image forming apparatus, as described above, toner can be fixed thus more efficiently on the recording medium.

Figure 7A:
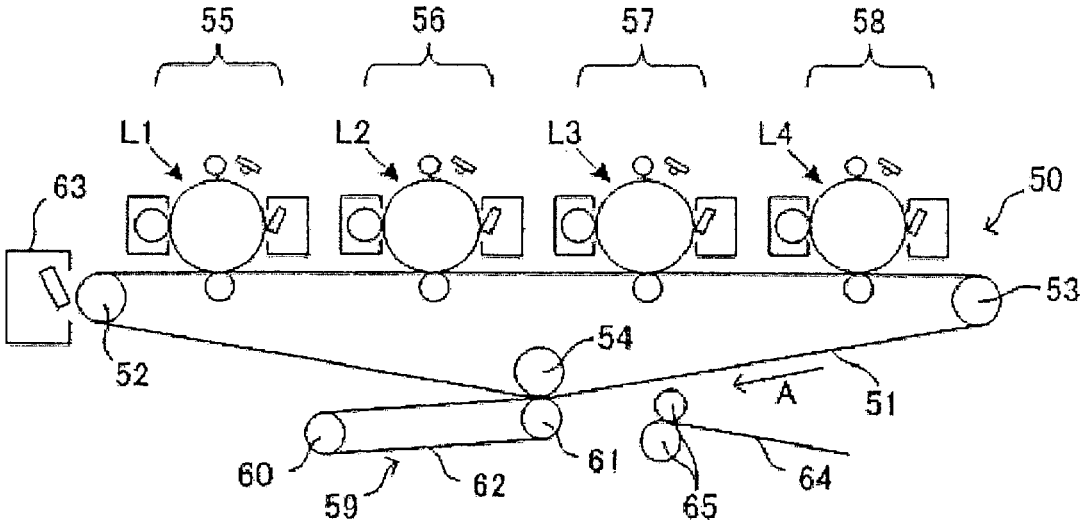
FIGS. 7A and 7B are diagrams illustrating an example of the schematic constitution of an image forming apparatus of another embodiment of the present invention.
Figure 7B:
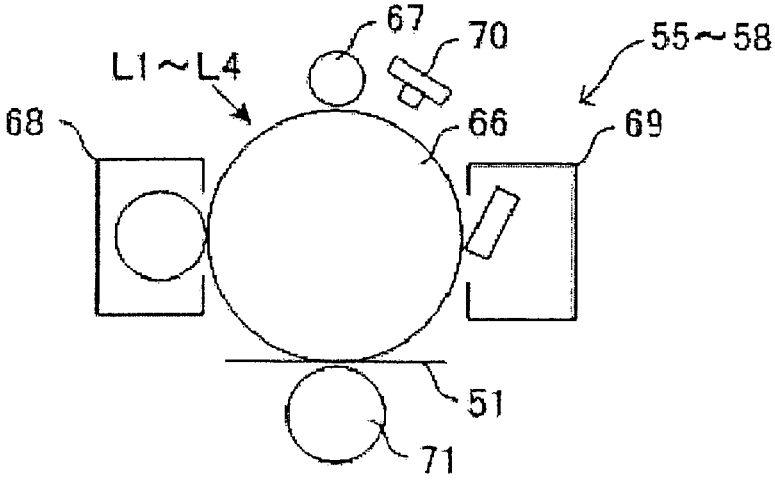

FIGS. 7A and 7B are diagrams illustrating the constitution of an image forming apparatus of another embodiment of the present invention. The image forming apparatus illustrated in the figure may be a copying machine or a printer. FIG. 7A is a schematic diagram illustrating globally a color-electrophotographic tandem-type image forming apparatus, and FIG. 7B is a diagram illustrating the constitution of one image forming unit of the image forming apparatus shown in FIG. 7A. The image forming apparatus 50 shown in FIGS. 7A and 7B includes an intermediate transfer belt 51 as a toner image carrier. The intermediate transfer belt 51, which is tensioned on three supporting rollers 52 to 54, rotates in the direction denoted by the arrow A. Respective image forming units 55 to 58 for black, yellow, magenta and cyan are arranged on the intermediate transfer belt 51.

Above these image forming units are arranged light-exposure devices which are not shown in the figure. For example, when the image forming apparatus is a copying machine, image information of an original copy is read by a scanner, and in accordance with this image information, the exposure devices irradiate respective exposure lights L1 through L4 for writing an electrostatic latent image on a respective photosensitive drum. A secondary transfer device 59 is provided at such a location so as to flank the intermediate transfer belt 51 and oppose the supporting roller 54 of the intermediate transfer belt 51. The secondary transfer device 59 comprises a secondary transfer belt 62 which is tensioned by two supporting rollers 60 and 61. Apart from the secondary transfer belt 62, a transfer roller may also be used as the secondary transfer device 59. A belt cleaning device 63 is arranged at such a location so as to flank the intermediate transfer belt 51 and oppose the supporting roller 52 of the intermediate transfer belt 51. The belt cleaning device 63 is arranged to eliminate toner remaining on the intermediate transfer belt 51.

Recording paper 64 as a recording medium is guided to a secondary transfer section by a pair of paper feeding rollers 65, and for transferring a toner image to the recording paper 64, the toner image is transferred by pushing the secondary transfer belt 62 against the intermediate transfer belt 51. The recording paper 64 on which the toner image is transferred is conveyed by the secondary transfer belt 62 and the unfixed toner image transferred on the recording paper 64 is fixed, in accordance with image information from the exposure devices not shown, by a fixing device of toner of the present invention in which the film thickness of the foam-like fixing liquid is controlled. That is, on the basis of image information such as a color image or a black solid image from the exposure devices not shown in the figure, foam-like fixing liquid of the present invention is supplied, from a fixing device of toner in which the film thickness of a foam-like fixing liquid layer is controlled, to an unfixed toner image transferred on the recording paper 64, whereupon the unfixed toner image becomes fixed on the recording paper 64 through the action of the component (softener) capable of dissolving or swelling at least one portion of the resin contained in the toner.

An image forming unit is described next. As shown in FIG. 7B, a charging device 67, a developing device 68, a cleaning device 69 and a charge eliminating device 70 are arranged around a photosensitive drum 66 of the image forming units 55 to 58. Also, a primary transfer device 71 is arranged at a position facing the photosensitive drum 66 through the intermediate transfer belt 51. The charging device 67 is a charging device according to a contact charging method which uses a charging roller. The charging device 67 uniformly charges the surface of the photosensitive drum 66 by bringing into contact the charging roller with the photosensitive drum 66 and applying a voltage to the photosensitive drum 66. A charging device according to a non-contact charging method, using a non-contact scorotron or the like, can be also used as the charging device 67. The developing device 68 causes the toner in a developing agent to adhere to an electrostatic latent image on the photosensitive drum 66, whereby the electrostatic latent image is made visible. Herein, toner corresponding to each color is composed of a resin material colored with the respective color, and capable of being dissolved or swelled by the fixing liquid of the present invention.

Additionally, the developing device 68 includes an agitation part and developing part which are not shown in the figure, while developing agent that has not been used for development returns to the agitation part and is recycled. The concentration of the toner in the agitation part is detected by a toner concentration sensor and the agitation part is controlled so that the concentration of the toner remains constant. The primary transfer device 71 transfers the toner visualized on the photosensitive drum 66 to the intermediate transfer belt 51. Herein, a transfer roller is employed as the primary transfer device 71, the transfer roller being pushed against the photosensitive drum 66 through the intermediate transfer belt 51. An electrically conductive brush, a non-contact corona charger or the like can be also used as the primary transfer device 71. The cleaning device 69 eliminates unwanted toner from the photosensitive drum 66. As the cleaning device 69 can be used, for instance, a blade having an end that pushes against the photosensitive drum 66.

Herein, the toner recovered by the cleaning device 69 is collected into the developing device 68, where it is recycled, by a collecting screw and toner recycle device not shown in the figure. The charge eliminating device 70, which comprises a lamp, initializes the surface electric potential of the photosensitive drum 66 by light irradiation.

Examples and comparative examples of the fixing liquid in the present invention are explained next. The softener for softening toner in the examples and comparative examples refers herein to a component for dissolving or swelling at least one portion of a resin contained in toner.

EXAMPLE 1

<Manufacture of a W/O Emulsion-Type Fixing Liquid>

Preparation of the oil phase

| | |
|---|---|
| Oil based solvent: Poly-α olefin compound (Spectrasyn 2 by Exxon Mobil Co.) | 24 wt % |
| Softener: diisobutyl adipate (KAK DIBA by Kokyu Alcohol Kogyo Co., Ltd.) | 56 wt % |

-continued

| | |
|---|---|
| Dispersant: sorbitan monooleate (Rheodol SP-010V, by Kao) | 10 wt % |
| sorbitan trioleate (Rheodol SP-030V, by Kao) | 10 wt % |

These constituents were mixed under stirring, with the listed component fractions, to prepare an oil phase liquid.

Preparation of the aqueous phase

| | |
|---|---|
| Ion exchange water | 95 wt % |
| Magnesium sulfate | 5 wt % |

These constituents were mixed under stirring, with the listed component fractions, to prepare an aqueous phase liquid.

The aqueous phase was gradually poured onto the oil phase while stirring the oil phase liquid in a beaker at 200 rpm using a rotating blade, to prepare thereby a W/O emulsion-type liquid of coarse aqueous phase microparticles. The mixture liquid where these coarse aqueous phase microparticles were dispersed was then stirred at 8000 rpm for 10 minutes with a rotating blade, to prepare a W/O emulsion-type fixing liquid in which the aqueous phase microparticle diameter was distributed over a range from 0.1 μm to 1 μm (measured using an apparatus by Microtrac Inc. (MicroTrac UPA) at a wavelength of 780 nm and a temperature of 25° C.). The viscosity of the prepared fixing liquid was measured at a temperature of 25° C. using a cone plate viscometer with cone angle 1°, cone diameter 60 mm, rotation 1/10 ($s^{-1}$). The residual oily feel on paper was evaluated by touch by 100 individuals that were asked whether the paper had an oily feel or not. If 70 or more subjects responded in the negative, it was judged that there was no residual oily feel.

W/O emulsion-type fixing liquids 1 to 5 were prepared by changing the ratio of aqueous phase to oil phase as set out in FIG. 8.

Using a fixing device such as the one illustrated in FIG. 6, the fixing liquid prepared in accordance with the formulation above was roller coated (coating amount: 0.2 g/A4 sheet) on PPC paper on which an unfixed toner image had been formed using an Ipsio Color CX8800 printer (by Ricoh Co. Ltd.) The surface of the image was rubbed with a waste cloth after 10 seconds, and the degree of toner fixing on the PPC paper was evaluated based on the presence or absence of adhesion of the toner to the waste cloth.

Rubbing with a waste cloth 10 seconds after application of the fixing liquid yielded no adhesion of toner to the waste cloth in none of the fixing liquids 2 to 5. In the fixing liquid 1, toner did not adhere to the waste cloth even after 30 seconds from application. The fixing liquid 6 exhibited a substantial residual oily feel, enough to make the paper feel somewhat like oiled paper. In the fixing liquid 5, the paper did not change after application but exhibited a slight residual oily feel, although within a permissible range. The fixing liquids 2 to 4 exhibited no residual oily feel. These results showed that fixing with excellent fixing responsiveness can be carried out, without residual oily feel, for a W/O ratio ranging from 5/5 to 9/1.

The fixing liquid 3 and the fixing liquid 4 contained less water than the fixing liquid 2, and hence suffered virtually no paper curl.

The fixing liquids 1 to 6 were left to stand for 1 month inside open containers, and although a mass decay of about 10 wt % occurred after the initial week, thereafter there was virtually no mass change. After storage for 1 month, there occurred no change in the component ratio that was substantial enough so as to hamper the fixability of the fixing liquids.

COMPARATIVE EXAMPLE 1

| | |
|---|---|
| Oil based solvent: Poly-α olefin compound (Spectrasyn 2 by Exxon Mobil Co.) | 30 wt % |
| Softener: diisobutyl adipate (KAK DIBA by Kokyu Alcohol Kogyo Co., Ltd.) | 70 wt % |

A fixing liquid was prepared on the basis of the above formulation by dissolving the softener in the oil based solvent.

Manufacture of an unfixed image and fixability evaluation were carried out in the same way as in Example 1. Application of the fixing liquid to the unfixed toner image was carried out using also the same fixing device as in Example 1, while the application amount, of 0.2 g/A4 sheet, was also identical to that of Example 1.

Fixability was deficient, with toner adhering to a waste cloth upon rubbing using the latter, even after a lapse of 30 seconds from fixing liquid application. It took 1 minute until the toner ceased to adhere to the waste cloth. Moreover, the paper exhibited a substantial residual oily feel.

EXAMPLE 2

<Manufacture of a W/O Emulsion-Type Fixing Liquid>

Preparation of the oil phase

| | |
|---|---|
| Oil based solvent: Poly-α olefin compound (Spectrasyn 2 by Exxon Mobil Co.) | refer to FIG. 9 |
| Softener: diisobutyl adipate (KAK DIBA by Kokyu Alcohol Kogyo Co., Ltd.) | refer to FIG. 9 |
| Dispersant: sorbitan monooleate (Rheodol SP-010V, by Kao) | 10 wt % |
| Sorbitan trioleate (Rheodol SP-030V, by Kao) | 10 wt % |

These constituents were mixed under stirring, with the listed component fractions, to prepare an oil phase liquid.

Preparation of the aqueous phase

| | |
|---|---|
| Ion exchange water | 95 wt % |
| Magnesium sulfate | 5 wt % |

These constituents were mixed under stirring, with the listed component fractions, to prepare an aqueous phase liquid.

With the W/O weight ratio fixed at 6/4, W/O emulsion-type fixing liquids were prepared by changing the ratio of oil based solvent relative to the softener in the oil phase as set out in FIG. 9.

The aqueous phase was gradually poured onto the oil phase while stirring the oil phase liquid in a beaker at 200 rpm using a rotating blade, to prepare thereby a W/O emulsion-type liquid of coarse aqueous phase microparticles. The mixture liquid where these coarse aqueous phase microparticles were dispersed was then stirred at 8000 rpm for 10 minutes with a rotating blade, to prepare a W/O emulsion-type fixing liquid in which the aqueous phase microparticle diameter was distributed over a range from 0.1 μm to 1 μm.

Using a fixing device such as the one illustrated in FIG. 5, the fixing liquid prepared in accordance with the formulation above was roller coated (coating amount: 0.2 g/A4 sheet) on PPC paper on which an unfixed toner image had been formed using an Ipsio Color CX8800 printer (by Ricoh Co. Ltd.). The surface of the image was rubbed with a waste cloth after 10 seconds, and the degree of toner fixing on the PPC paper was evaluated based on the presence or absence of adhesion of the toner to the waste cloth. The residual oily feel was evaluated in the same way as in Example 1, on the basis of a sensory evaluation survey.

Rubbing with a waste cloth 10 seconds after application of the fixing liquid yielded no adhesion of toner to the waste cloth in none of the fixing liquids 7 to 9. In the fixing liquid 10, toner did not adhere to the waste cloth even after 1 minute from application. In the fixing liquids 7 to 10, the paper did not change after application, while residual oily feel was within a permissible range. These results showed that fixing with excellent fixing responsiveness can be carried out, without residual oily feel, for a ratio of oil based solvent relative to the softener in the oil phase ranging from 0/100 to 7/3.

EXAMPLE 3

<Manufacture of a W/O Emulsion-Type Fixing Liquid>

Preparation of the oil phase

| | |
|---|---|
| Oil based solvent: Poly-α olefin compound (Spectrasyn 2 by Exxon Mobil Co.) | 40 wt % |
| Softener: diethoxyethyl succinate (Crodamol DES, Croda Japan Co.) | 40 wt % |
| Dispersant: sorbitan monooleate (Rheodol SP-010V, by Kao) | 10 wt % |
| Sorbitan trioleate (Rheodol SP-030V, by Kao) | 10 wt % |

These constituents were mixed under stirring, then a softener-dispersed oil phase liquid having a softener particle diameter ranging from 1 μm to 10 μm was prepared using an ultrasound homomixer.

Preparation of the aqueous phase

| | |
|---|---|
| Ion exchange water | 95 wt % |
| Magnesium sulfate | 5 wt % |

These constituents were mixed under stirring, with the listed component fractions, to prepare an aqueous phase liquid.

The aqueous phase was gradually poured onto the oil phase while stirring the oil phase liquid in a beaker at 200 rpm using a rotating blade, to prepare thereby a W/O emulsion-type liquid of coarse aqueous phase microparticles. The mixture liquid where these coarse aqueous phase microparticles were dispersed was then stirred at 8000 rpm for 10 minutes with a rotating blade, to prepare a W/O emulsion-type fixing liquid in which the aqueous phase microparticle diameter was distributed over a range from 0.1 μm to 1 μm. The weight ratio of aqueous phase to oil phase was 6/4. The viscosity was 0.9 Pa·s.

Using a fixing device such as the one illustrated in FIG. 5, the fixing liquid prepared in accordance with the formulation above was roller coated (coating amount: 0.2 g/A4 sheet) on PPC paper on which an unfixed toner image had been formed using an Ipsio Color CX8800 printer (by Ricoh Co. Ltd.). The surface of the image was rubbed with a waste cloth after 10 seconds, and the degree of toner fixing on the PPC paper was evaluated based on the presence or absence of adhesion of the toner to the waste cloth. The residual oily feel was evaluated in the same way as in Example 1, on the basis of a sensory evaluation survey.

Rubbing with a waste cloth 5 seconds after application of the fixing liquid yielded no adhesion of toner to the waste cloth. This result proved that better fixing responsiveness can be achieved by dispersing the softener in the oil based solvent of the oil phase, than by dissolving the softener in the oil phase.

EXAMPLE 4

<Manufacture of a W/O Emulsion-Type Fixing Liquid>

Preparation of the oil phase

| | |
|---|---|
| Oil based solvent: Dimethyl silicone (SH200-50cs by Dow Corning Toray Silicone) | 12 wt % |
| Poly-α olefin compound (Spectrasyn 2 by Exxon Mobil Co.) | 12 wt % |
| Softener: hexyl laurate (KAK HL by Kokyu Alcohol Kogyo Co., Ltd.) | 56 wt % |
| Dispersant: sorbitan monooleate (Rheodol SP-010V, by Kao) | 10 wt % |
| Sorbitan trioleate (Rheodol SP-030V, by Kao) | 10 wt % |

These constituents were mixed under stirring, with the listed component fractions, to prepare an oil phase liquid.

Preparation of the aqueous phase

| | |
|---|---|
| Ion exchange water | 95 wt % |
| Magnesium sulfate | 5 wt % |

These constituents were mixed under stirring, with the listed component fractions, to prepare an aqueous phase liquid.

The aqueous phase was gradually poured onto the oil phase while stirring the oil phase liquid in a beaker at 200 rpm using a rotating blade, to prepare thereby a W/O emulsion-type liquid of coarse aqueous phase microparticles. The mixture liquid where these coarse aqueous phase microparticles were dispersed was then stirred at 8000 rpm for 10 minutes with a rotating blade, to prepare a W/O emulsion-type fixing liquid in which the aqueous phase microparticle diameter was distributed over a range from 0.1 μm to 1 μm. The weight ratio of aqueous phase to oil phase was 6/4. The viscosity was 1 Pa·s.

Using a fixing device such as the one illustrated in FIG. 6, the fixing liquid prepared in accordance with the formulation above was roller coated (coating amount: 0.2 g/A4 sheet) on PPC paper on which an unfixed toner image had been formed using an Ipsio Color CX8800 printer (by Ricoh Co. Ltd.). The surface of the image was rubbed with a waste cloth after 10 seconds, and the degree of toner fixing on the PPC paper was evaluated based on the presence or absence of adhesion of the toner to the waste cloth.

As a result, rubbing with a waste cloth 10 seconds after application of the fixing liquid yielded no adhesion of toner to the waste cloth.

EXAMPLE 5

<Manufacture of a W/O Emulsion-type Fixing Liquid>

Preparation of the oil phase

| | |
|---|---|
| Oil based solvent: Poly-α olefin compound (Spectrasyn 2 by Exxon Mobil Co.) | 80 wt % |
| Dispersant: sorbitan monooleate (Sylvan S80, by Matsumoto Yushi-Seiyaku Co., Ltd.) | 10 wt % |
| Sorbitan trioleate (Rheodol SP-030V, by Kao) | 10 wt % |

These constituents were mixed under stirring, with the listed component fractions, to prepare an oil phase liquid.

Preparation of the aqueous phase

| | |
|---|---|
| Ion exchange water | 89 wt % |
| Softener: diethoxyethyl succinate | 6 wt % |
| Magnesium sulfate | 5 wt % |

These constituents were mixed under stirring, with the listed component fractions, to prepare an aqueous phase liquid. This time diethoxyethyl succinate, as the softener, was dissolved in the aqueous phase.

The aqueous phase was gradually poured onto the oil phase while stirring the oil phase liquid in a beaker at 200 rpm using a rotating blade, to prepare thereby a W/O emulsion-type liquid of coarse aqueous phase microparticles. The mixture liquid where these coarse aqueous phase microparticles were dispersed was then stirred at 12000 rpm for 10 minutes with a rotating blade, to prepare a W/O emulsion-type fixing liquid in which the aqueous phase microparticle diameter was distributed over a range from 0.1 μm to 1 μm. The viscosity of the prepared fixing liquid, of 0.8 Pa·s, was measured at a temperature of 25° C. using a cone plate viscometer with cone angle 1°, cone diameter 60 mm, rotation 1/10 ($s^{-1}$).

Using a fixing device such as the one illustrated in FIG. 6, the fixing liquid prepared in accordance with the formulation above was roller coated (coating amount: 0.2 g/A4 sheet) on PPC paper on which an unfixed toner image had been formed using an Ipsio Color CX8800 printer (by Ricoh Co. Ltd.) The surface of the image was rubbed with a waste cloth after 10 seconds, and the degree of toner fixing on the PPC paper was evaluated based on the presence or absence of adhesion of the toner to the waste cloth. The residual oily feel was evaluated in the same way as in Example 1, on the basis of a sensory evaluation survey.

As a result, rubbing with a waste cloth 10 seconds after application of the fixing liquid yielded no adhesion of toner to the waste cloth. Furthermore, rubbing 5 seconds after application the fixing liquid yielded no adhesion of toner, either. There was a slight residual oily feel, but unproblematic and within the permissible range.

EXAMPLE 6

<Manufacture of a W/O Emulsion-Type Fixing Liquid>

Preparation of the oil phase

| | |
|---|---|
| Oil based solvent: Poly-α olefin compound (Spectrasyn 2 by Exxon Mobil Co.) | 24 wt % |
| Softener: dibutyl sebacate (by Kanto Chemical Co.) | 56 wt % |

-continued

| | |
|---|---|
| Dispersant: sorbitan monooleate (Sylvan S80, by Matsumoto Yushi-Seiyaku Co., Ltd.) | 10 wt % |
| Sorbitan trioleate (Rheodol SP-030V, by Kao) | 10 wt % |

These constituents were mixed under stirring, with the listed component fractions, to prepare an oil phase liquid.

Preparation of the aqueous phase

| | |
|---|---|
| Ion exchange water | 89 wt % |
| Softener: diethoxyethyl succinate | 6 wt % |
| Magnesium sulfate | 5 wt % |

These constituents were mixed under stirring, with the listed component fractions, to prepare an aqueous phase liquid. This time diethoxyethyl succinate, as the softener, was dissolved in the aqueous phase.

The aqueous phase was gradually poured onto the oil phase while stirring the oil phase liquid in a beaker at 200 rpm using a rotating blade, to prepare thereby a W/O emulsion-type liquid of coarse aqueous phase microparticles. The mixture liquid where these coarse aqueous phase microparticles were dispersed was then stirred at 12000 rpm for 10 minutes with a rotating blade, to prepare a W/O emulsion-type fixing liquid in which the aqueous phase microparticle diameter was distributed over a range from 0.1 μm to 1 μm. The viscosity of the prepared fixing liquid, of 0.8 Pa·s, was measured at a temperature of 25° C. using a cone plate viscometer with cone angle 1°, cone diameter 60 mm, rotation 1/10 ($s^{-1}$).

Using a fixing device such as the one illustrated in FIG. 4, the fixing liquid prepared in accordance with the formulation above was roller coated (coating amount: 0.2 g/A4 sheet) on PPC paper on which an unfixed toner image had been formed using an Ipsio Color CX8800 printer (by Ricoh Co. Ltd.). The surface of the image was rubbed with a waste cloth after 10 seconds, and the degree of toner fixing on the PPC paper was evaluated based on the presence or absence of adhesion of the toner to the waste cloth. The residual oily feel was evaluated in the same way as in Example 1, on the basis of a sensory evaluation survey.

As a result, rubbing with a waste cloth 10 seconds after application of the fixing liquid yielded no adhesion of toner to the waste cloth. Furthermore, rubbing 5 seconds after application the fixing liquid yielded no adhesion of toner, either. There was a slight residual oily feel, but unproblematic and within the permissible range.

The present invention affords the following effects:

(1) The fixing liquid of the present invention is a fixing liquid for fixing resin microparticles to a medium, the fixing liquid being a water-in-oil type fixing liquid comprising a continuous oil phase at least one portion of which comprises a softener for softening the resin microparticles by dissolving or swelling at least one portion of the resin microparticles, and an aqueous phase, as a separate phase, dispersed in the oil phase. As a result, the fixing liquid combines preservability during storage and drying property on a medium after application of the fixing liquid, is free of residual oily feel during application, and affords better fixing responsiveness than conventional fixing liquids.

(2) The oil phase comprises a nonvolatile solvent, and moreover the nonvolatile solvent is non-polar. As a result, evaporation of the solvent in the oil phase is curbed, environmental pollution problems are forestalled, and change in the component ratio during preservation of the fixing liquid is reduced to a minimum, which enhances reliability.

(3) The resin microparticles contain a coloring agent and a charge control agent.

(4) The softener is dispersed in the oil phase in the form of particles, and hence the softener is provided efficiently to a resin microparticle layer such as toner, thereby enhancing fixing responsiveness.

(5) The ratio of the aqueous phase to the oil phase is preferably 5/5 to 9/1.

(6) The oil phase comprises an oil based solvent and a softener, and the weight ratio of the oil based solvent to the softener is 7/3 or less. This results in enhanced reliability, as the ratio of oil phase to aqueous phase does not give rise to dispersion instability or fixing defects on account of excessively increased viscosity.

(7) The softener comprises preferably an aliphatic ester. The aliphatic ester comprises preferably a saturated aliphatic ester. The saturated aliphatic ester comprises a compound represented by general formula R1COOR2, where R1 is a C11 to C14 alkyl group, and R2 is a C1 to C6 alkyl group. Also, the aliphatic ester comprises preferably an aliphatic dicarboxylate ester. The aliphatic dicarboxylate ester comprises a compound represented by general formula $R3(COOR4)_2$, where R3 is a C3 to C8 alkylene group, and R4 is a C2 to C5 alkyl group. Also, the aliphatic ester comprises preferably a dialkoxyalkyl aliphatic dicarboxylate. Further, the dialkoxyalkyl aliphatic dicarboxylate comprises a compound represented by general formula $R5\ (COOR6\text{-}O\text{—}R7)_2$, where R5 is a C2 to C8 alkylene group, R6 is a C2 to C4 alkylene group, and R7 is a C1 to C4 alkyl group.

(8) When the oil phase comprises an olefin compound, very small amounts of fixing liquid can dissolve or swell a resin, most rapidly for microparticles containing a resin, in particular a toner; also, olefins are a group of safe compounds that have absolutely no irritating odor, and which enhance thus the safety and fixing responsiveness of the fixing liquid.

(9) Reliability of the fixing liquid during storage increases when the oil phase comprises dimethyl silicone, which is a compound group that allows forming a W/O emulsion most stably in case that the oil phase contains a component (softener) capable of dissolving or swelling a resin; also, dimethyl silicone is a group of safe compounds that have absolutely no irritating odor.

(10) When the softener is comprised in the aqueous phase, the opportunities for the microparticles such as toner of coming into contact with the softener increase, which further enhances fixing responsiveness.

(11) The fixing method of the present invention is characterized by applying the above fixing liquid on unfixed resin microparticles adhered to a medium, to fix thereby the unfixed resin microparticles. As a result, a fixing method can be provided that combines preservability during storage and drying property on a medium after application of the fixing liquid, giving rise to no residual oily feel during application, and affording better fixing responsiveness than conventional fixing methods.

(12) The fixing device of the present invention is characterized by having application means for applying the above-described fixing liquid to unfixed resin microparticles adhered to a medium. As a result, a fixing device is provided that allows fixing on a recording medium microparticles such as toner containing a resin, effectively and with small application amounts, the microparticles such as toner containing a resin becoming rapidly fixed to the recording medium after application on the recording medium, without disturbing a microparticle layer of toner or the like containing a resin, and with no residual oily feel occurring in the recording medium, the fixing liquid having moreover excellent preservability since the component ratio thereof does not change during storage.

(13) The image forming method of the present invention comprises the steps of fixing an unfixed toner by applying the above-described fixing liquid to unfixed toner adhered to a recording medium, and forming an image on the recording medium. As a result, a fixing method is provided that is excellent in fixing responsiveness and which allows preventing the occurrence of image blank spots, since the microparticle layer such as toner is not disturbed.

(14) The image forming apparatus of the present invention is characterized by comprising image forming means for carrying out an electrostatic recording process with toner comprising a resin and for forming an unfixed toner image on a recording medium; and fixing means using the above-described fixing device for fixing the unfixed toner image on the recording medium. As a result, an image forming apparatus is provided that allows fixing on a recording medium microparticles such as toner containing a resin, effectively and with small application amounts, the microparticles such as toner containing a resin becoming rapidly fixed to the recording medium after application on the recording medium, without disturbing a microparticle layer of toner or the like containing a resin, and with no residual oily feel occurring in the recording medium, the fixing liquid having moreover excellent preservability since the component ratio thereof does not change during storage. The image forming apparatus, also, is excellent in fixing responsiveness, allows preventing the occurrence of image blank spots, and allows enhancing image quality.

Thus, the fixing liquid of the present invention combines preservability during storage and drying property on a medium after application of the fixing liquid, is free of residual oily feel during application, and affords better fixing responsiveness than conventional fixing liquids.

Various modifications will become possible for those skilled in the art after receiving the teachings of the present disclosure without departing from the scope thereof.

What is claimed is:

1. A fixing liquid for fixing resin microparticles to a medium, wherein the fixing liquid comprises resin microparticles and is a water-in-oil type fixing liquid comprising a continuous oil phase at least one portion of which comprises a softener for softening the resin microparticles by dissolving or swelling at least one portion of the resin microparticles, and an aqueous phase, as a separate phase, dispersed in the oil phase with a dispersant, wherein the dispersant comprises a combination of sorbitan monooleate and sorbitan trioleate;

wherein the softener comprises a dialkoxyalkyl aliphatic dicarboxylate represented by general formula $R_5(COOR_6OR_7)_2$, where $R_5$ is a $C_2$ to $C_8$ alkylene group, $R_6$ is a $C_2$ to $C_4$ alkylene group, and $R_7$ is a $C_1$ to $C_4$ alkyl group; and wherein the resin microparticles in the fixing liquid have a particle size of from 0.1 μm to 6 μm.

2. The fixing liquid as claimed in claim 1, wherein the oil phase comprises a nonvolatile solvent.

3. The fixing liquid as claimed in claim 2, wherein the nonvolatile solvent is non-polar.

4. The fixing liquid as claimed in claim 1, wherein the softener is dispersed in the oil phase in the form of particles.

5. The fixing liquid as claimed in claim 1, wherein the ratio of the aqueous phase to the oil phase is 5/5 to 9/1.

6. The fixing liquid as claimed in claim 1, wherein the oil phase comprises an oil based solvent and the softener, and wherein the weight ratio of the oil based solvent to the softener is 7/3 or less.

7. The fixing liquid as claimed in claim 1, wherein the oil phase comprises an olefin compound.

8. The fixing liquid as claimed in claim 1, wherein the oil phase comprises dimethyl silicone.

9. The fixing liquid as claimed in claim 1, wherein the aqueous phase comprises the softener.

10. A fixing device having application means for applying a fixing liquid to unfixed resin microparticles adhered to a medium, wherein the fixing liquid is as claimed in claim 1.

11. An image forming apparatus, comprising:

image forming means for carrying out an electrostatic recording process with toner comprising a resin and for forming an unfixed toner image on a recording medium; and fixing means for fixing the unfixed toner image on the recording medium using a fixing device, wherein the fixing device has application means for applying a fixing liquid to resin microparticles of the unfixed toner image on the recording medium, and the fixing liquid is as claimed in claim 1.

* * * * *